United States Patent [19]

Sperling

[11] Patent Number: 4,910,937

[45] Date of Patent: Mar. 27, 1990

[54] TILE-WALL ASSEMBLY WITH CLOSURE PANEL

[76] Inventor: Karl-Heinz Sperling, Toricelligasse 37, 1140 Wien, Austria

[21] Appl. No.: 116,486

[22] Filed: Nov. 2, 1987

[30] Foreign Application Priority Data

Dec. 10, 1986 [AT] Austria ..... 3285/86

[51] Int. Cl.[4] ..... E04C 2/00

[52] U.S. Cl. ..... 52/511

[58] Field of Search ..... 49/394, 463; 52/136, 52/137, 139, 204, 207, 235, 243.1, 309.1, 415, 511; 70/379

[56] References Cited

U.S. PATENT DOCUMENTS

| | | | |
|---|---|---|---|
| 421,567 | 2/1890 | Grah, Jr. | 70/279 |
| 1,194,637 | 8/1916 | Joy | 49/394 X |
| 1,452,014 | 4/1923 | Wolfe et al. | 70/279 |
| 1,535,403 | 4/1925 | Ellison | 49/394 X |
| 2,147,794 | 2/1939 | Leonard et al. | 49/394 X |
| 2,288,637 | 7/1942 | Mauro | 52/36 |
| 4,573,333 | 3/1986 | Choi | 70/279 |
| 4,679,368 | 7/1987 | Pettinga et al. | 52/36 |

FOREIGN PATENT DOCUMENTS

| | | | |
|---|---|---|---|
| 2106483 | 9/1971 | Fed. Rep. of Germany . | |
| 2269923 | 11/1976 | France . | |
| 380160 | 9/1932 | United Kingdom | 49/463 |

OTHER PUBLICATIONS

SPERKA, Technical Report—01.03.86.

No. 88 Catalog of McMaster—Carr, pp. 728–733, dated 1982.

*Primary Examiner*—John E. Murtagh

*Assistant Examiner*—Michele A. Van Patten

*Attorney, Agent, or Firm*—Herbert Dubno

[57] ABSTRACT

A wall opening in a tile wall is closed by tile panel which is held in place by a spring-loaded snap catch at one edge of the rear of the panel and along the opposite edge by a channel engaging a tongue.

8 Claims, 1 Drawing Sheet

TILE-WALL ASSEMBLY WITH CLOSURE PANEL

FIELD OF THE INVENTION

My present invention relates to a tile-wall assembly having an opening provided with a closure panel and means for assembly retaining that panel in the opening, the panel being provided with tiles to match the wall and flush therewith. More particularly, the invention relates to a holder or retaining mechanism for the removable closing of an opening in the tile wall and which consists of two holder units along opposite edges of the panel, at least one of which is a detent formed with a spring-loaded snap-catch engageable with a strike or other retaining element.

BACKGROUND OF THE INVENTION

It is known to mount a tiled panel in an opening in a tiled wall and to provide that panel with a catch arrangement which retains the panel removably in the opening.

In the past such catches have made use of permanent magnets which have proved to be advantageous because they allow a secure retention of the panel in the opening even if there is no exact alignment with portions of the catch which may engage one another.

The advantage of a spring-loaded snap-catch, of course, is that it can provide a satisfactory degree of retention force.

With conventional holding units, one inserts one edge of the panel into the opening and then swings the remainder of the panel into coplanarity with the wall so that the catch can engage. It is desirable that the assembly have the advantages of a permanent magnet system with respect to possible inexact alignment, as well as the advantages of a snap catch with respect to the retention force provided.

OBJECTS OF THE INVENTION

It is the principal object of the present invention to provide a tile-wall assembly which has an improved holder arrangement for retaining a closure panel in an opening of tiled wall whereby drawbacks of prior art systems are avoided.

It is another object of this invention to provide a holder system for a tiled panel for use in a closure of an opening in a tiled wall such that positioning and setting of the panel is simplified while the panel is nevertheless retained against undesired dislocation in a particularly convenient and economical manner.

Yet another object of this invention is to provide an improved holder arrangement in a closure for an opening in a tile wall which is of simple and economical construction, is easy to use and retains the advantages of earlier closure systems.

SUMMARY OF THE INVENTION

These objects and others which will become apparent hereinafter are attained, in accordance with the invention by providing a holder arrangement for a tiled panel adapted to fit in an opening in a tiled wall which comprises at least one channel-shaped profile or member which cooperates with a projection extending into a channel of this member alongside of the panel opposite that at which a spring-loaded snap-catch is provided.

Advantageously, the projecting member can be a tongue whose length is equal to the length of the channel-shaped member, the channel-shaped member itself preferably extending substantially the full width of the panel.

Advantageously the channel-forming member is provided on the panel while the tongue formation forms part of an L-shaped or T-shaped strip mounted on the tiled wall along an edge of the opening opposite that at which the snap catch is provided.

The tongue or ledge need then only be seated in the groove of the channel so that the panel can then be swung into the opening to engage the snap catch with its strike at the other side of the opening.

In spite of the simplicity and ease of handling, the tendency for an undesired release of the panel is sharply limited and even eliminated so that, by comparison with conventional holding systems, a much more reliable retention of the panel is ensured.

The channel-forming member and the strip formed with the tongue or ledge can be cemented by standard adhesives with the panel back and the edge of the opening of the wall, respectively.

The invention also provides a stiffening of the cover members. For example, the channel-forming member can be a strip secured to the back of the panel to reinforce the latter. In addition, however, reinforcing ribs of synthetic resin material can be applied to the back of the panel by cementing to provide further reinforcement. The panel can comprise a plate which is perforated to improve adhesion of the tile adhesive and the tile to a front face of the plate while the rear face carries the snap catch and the plastic channel-forming strip which is bonded to this plate over the full width thereof.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
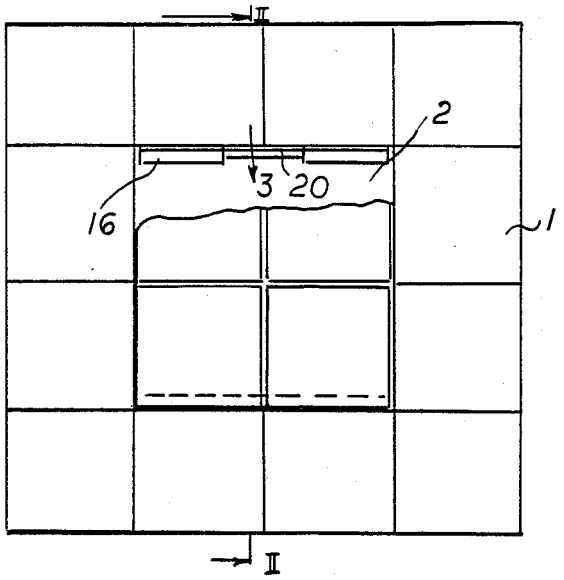
FIG. 1 is an elevational view of a portion of a tiled wall provided with an opening and a closure panel for this opening which has been partly broken way to show the strike cooperating with the snap catch.
Figure 2:
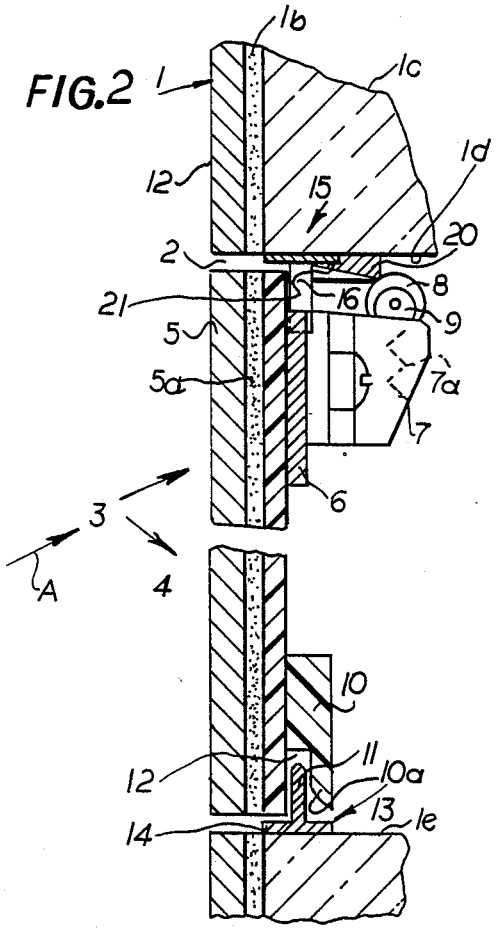
FIG. 2 is a section taken generally along the line II—II of FIG. 1 but drawn to a much larger scale.
Figure 3:
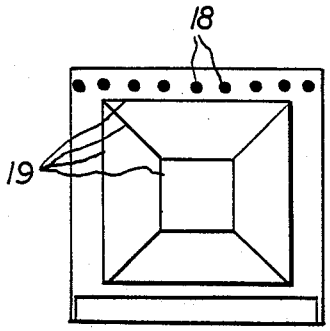
FIG. 3 is an elevational view of the rear of the panel illustrating only one line of perforations although the plate generally is uniformly perforated over its entire area, and with the snap catch removed.

FIG. 1 shows a tile wall 1 provided with a rectangular opening 2 which can be closed by a closure panel 3 of rectangular shape dimensioned to fit into the opening with clearances which are small and of the order of width of the grout strips between the tiles.

In the drawing, the tiles of the wall have been shown at 1*a* to be attached by adhesive 1*b* to the wall structure 1*c* defining the opening. Around the opening, the wall structure 1*c* is formed with horizontal ledges 1*d* and 1*e*.

The panel 3, in turn, comprises a synthetic resin plate 4 to which the tiles 5 are connected by the layer of adhesive 5

At the upper edge of the panel, through the intermediary of a plate 6, a commercial spring-loaded roller snap catch 7 is attached by screw 7*b*.

The snap catch 7 which is of a type conventionally used in cabinet work, has a spring-loaded roller 8 mounted in a journal 9. The spring has been represented in broken lines at *7a*.

Upon arrangement with the strike, therefore, the roller 8 is pressed inwardly against the spring force until the roller clears the strike.

Along the other edge of the panel 3 a channel-shaped profile 10 of synthetic resin material is bonded to the rear surface of the plate 4 by an adhesive and extends substantially the entire width of the plate 4.

On the surface 1*e* bounding the bottom of the opening 2, a strip 13 is affixed which has a base or flange 14 secured at the edge of the opening 2 to the wall structure.

The strip 13 also includes a tongue or ledge 11 which projects into the groove 12 defined by the profile 10, i.e. into the channel.

The tongue 11 and the flange 14 form a T-shaped profile or strip 13 and an L-shaped profile or strip can also be used.

At the upper side of the opening secured on the surface 1*d*, the strike 15 is formed with a T-shaped profile whose ledge or rib 16 is cut away in the region of the catch 7.

Even the upper member or strike 15 can be formed as an L-section profile.

The plate 4 is perforated to improve the bonding of the tiles 5 via the adhesive 5*a* to the plate 4. To prevent obscuring the rest of the drawing, only one row of holes 18 forming the perforations has been shown.

The back side of the plate 4 has reinforcing ribs 19 secured thereto by adhesive to increase the stiffness imparted to the file in conjunction with the stiffening profile 10.

To close the opening 2, it is merely necessary to set the lower edge of the panel into the opening and engage the tongue 11 in the groove 12. To facilitate this, the lip 10*a* of the channel 10 is rounded. Thereupon the panel is swung into the opening (arrow A) until the roll upon being compressed by the ramp 21 of the abutment 20 of the strike is cleared by the roller 8 and comes to rest against the rear edge of the strike. In this position the panel is held in place or can be pulled out of the opening, e.g. by the insertion of a tool into the gap illustrated between the periphery of the panel and the edge of opening 2.

While only a single catch has been illustrated, it will be understood that with wider panels, a plurality of catches may be used. The strip 11 and the profile 10 can be fabricated in a number of parts.

Instead of a continuous tongue, a row of steel nails, pins or screws may engage in the channel.

The channel may be provided on the wall and the strip on the channel.

These and other modifications within the spirit and scope of the invention are intended to be encompassed in the appended claims.

I claim:

1. A tile-wall assembly, comprising:

a tiled wall formed with an opening;

a tiled panel dimensioned to fit into said opening to close said opening;

spring-loaded snap-catch means connecting one side of said panel to said wall in said opening;

a channel member and a projection member on an opposite side of said panel from said spring-loaded snap-catch means and interfitting upon an initial insertion of said panel into said opening to permit swinging of said panel to cause engagement of said spring-loaded snap-catch means so that a tiled face of said panel is coplanar with a tiled face of said wall, one of said members being provided on a face of said panel opposite said tiled face thereof, the other of said members being provided on said wall in said opening inwardly of said tiled face of said wall.

2. The tile-wall assembly defined in claim 1 wherein said projection member is a ledge receivable in said channel member.

3. The tile-wall assembly defined in claim 2 wherein said ledge forms part of a T-section strip.

4. The tile-wall assembly defined in claim 2 wherein said ledge forms part of a L-shaped section strip.

5. The tile-wall assembly defined in claim 2 wherein said channel member is a strip defining a channel with a rear surface of said panel and extending substantially the full width thereof.

6. The tile-wall assembly defined in claim 5 wherein said panel comprises a perforated synthetic resin plate on which tiles are cemented.

7. The tile-wall assembly defined in claim 6 wherein said strip is composed of a synthetic resin.

8. The tile-wall assembly defined in claim 6, further comprising reinforcing ribs cemented to said rear surface.

* * * * *